US007771087B2

(12) United States Patent
Wilcox et al.

(10) Patent No.: US 7,771,087 B2
(45) Date of Patent: Aug. 10, 2010

(54) LED LIGHT FIXTURE WITH UNINTERRUPTIBLE POWER SUPPLY

(75) Inventors: Kurt S. Wilcox, Libertyville, IL (US); Wayne Guillien, Franksville, WI (US); Steve Walczak, Hales Corners, WI (US)

(73) Assignee: Ruud Lighting, Inc., Racine, WI (US)

( * ) Notice: Subject to any disclaimer, the term of this patent is extended or adjusted under 35 U.S.C. 154(b) by 552 days.

(21) Appl. No.: 11/744,732

(22) Filed: May 4, 2007

(65) Prior Publication Data

US 2008/0080162 A1 Apr. 3, 2008

(51) Int. Cl.
*F21V 19/04* (2006.01)

(52) U.S. Cl. ..... 362/294; 362/373; 362/249.02; 362/183; 362/800

(58) Field of Classification Search ..... 362/800, 362/249.02, 373, 249, 294, 183
See application file for complete search history.

(56) References Cited

U.S. PATENT DOCUMENTS

| | | | | |
|---|---|---|---|---|
| 3,860,829 | A | 1/1975 | Fabbri | |
| 4,071,749 | A | 1/1978 | Balogh | |
| 4,156,891 | A | 5/1979 | Roche | |
| 5,004,953 | A | 4/1991 | McDonald | |
| 5,303,124 | A | 4/1994 | Wrobel | |
| 5,633,564 | A | 5/1997 | Edwards et al. | |
| 5,676,455 | A | 10/1997 | Johnson et al. | |
| 5,909,062 | A | 6/1999 | Krietzman | |
| 5,988,829 | A | 11/1999 | Holder | |
| 6,045,232 | A | 4/2000 | Buckmaster | |
| 6,522,263 | B2 * | 2/2003 | Jones | 340/915 |
| 6,648,496 | B1 | 11/2003 | Elghoroury et al. | |
| 6,784,351 | B2 * | 8/2004 | Hauptmann et al. | 800/323 |
| 6,784,357 | B1 * | 8/2004 | Wang | 136/244 |
| 6,815,724 | B2 | 11/2004 | Dry | |
| 6,957,905 | B1 | 10/2005 | Pritchard et al. | |
| 7,036,961 | B2 | 5/2006 | Defouw et al. | |
| 7,090,370 | B2 * | 8/2006 | Clark et al. | 362/183 |
| 7,114,830 | B2 | 10/2006 | Robertson et al. | |

(Continued)

FOREIGN PATENT DOCUMENTS

EP 1 431 653 6/2004

(Continued)

OTHER PUBLICATIONS

PCT International Search Report and Written Opinion, PCT/2008/005855, 7 pages, Dated: Jul. 15, 2008.

(Continued)

*Primary Examiner*—Anabel M Ton
(74) *Attorney, Agent, or Firm*—Jansson Shupe & Munger Ltd.

(57) ABSTRACT

A permanently-installable LED light fixture including a housing including a substantially water-tight chamber, at least one electronic normal-operation LED-driver enclosed within the chamber and receiving power from a general off-location power source during normal operation, an LED assembly secured with respect to the housing, the LED assembly having at least one LED-array module, and at least one backup battery within the chamber capable of providing power during a power outage. In certain preferred embodiments at least one electronic backup LED-driver unit is enclosed within the chamber, the backup LED-driver unit drawing battery power during a power outage.

28 Claims, 14 Drawing Sheets

U.S. PATENT DOCUMENTS

| | | | | |
|---|---|---|---|---|
| 7,153,004 | B2 | 12/2006 | Galli | |
| 7,178,941 | B2 | 2/2007 | Roberge et al. | |
| 7,199,529 | B2 | 4/2007 | Vernon-Dier | |
| 7,234,844 | B2 | 6/2007 | Bolta et al. | |
| 7,244,042 | B1 * | 7/2007 | Bieberdorf | 362/183 |
| 7,267,459 | B2 | 9/2007 | Matheson | |
| 7,278,761 | B2 | 10/2007 | Kuan | |
| 7,303,301 | B2 | 12/2007 | Koren et al. | |
| 7,503,669 | B2 * | 3/2009 | Rizkin et al. | 362/183 |
| 2004/0036629 | A1 | 2/2004 | Jones et al. | |
| 2004/0257006 | A1 | 12/2004 | Beeman et al. | |
| 2005/0174762 | A1 * | 8/2005 | Fogerlie | 362/183 |
| 2006/0250803 | A1 * | 11/2006 | Chen | 362/373 |

FOREIGN PATENT DOCUMENTS

| | | |
|---|---|---|
| WO | WO 98/33007 | 7/1998 |
| WO | WO 99/57945 | 11/1999 |
| WO | WO 02/16826 | 2/2002 |
| WO | WO 03/089841 | 10/2003 |
| WO | WO 2006/060905 | 6/2006 |

OTHER PUBLICATIONS

Stanley Electric Co., Ltd. "Stanely LED for Street Lgiht Brochure." Date: Aug. 2006.

* cited by examiner

LED LIGHT FIXTURE WITH UNINTERRUPTIBLE POWER SUPPLY

RELATED APPLICATIONS

This application relates to U.S. application Ser. No. 11/541,908, filed on Sep. 30, 2006, the contents of which are incorporated herein by reference.

FIELD OF THE INVENTION

This invention relates to lighting fixtures and, more particularly, to lighting fixtures using LED modules.

BACKGROUND OF THE INVENTION

In recent years, the use of light-emitting diodes (LEDs) for various common lighting purposes has increased, and this trend has accelerated as advances have been made in LEDs and in LED arrays, often referred to as "LED modules." Indeed, lighting applications which previously had been served by fixtures using what are known as high-intensity discharge (HID) lamps are now beginning to be served by fixtures using LED-array-bearing modules. Such lighting applications include, among a good many others, factory lighting, commercial building lighting and various outdoor lighting such as parking lot lighting and roadway lighting.

Among the leaders in development of LED-array modules is Philips Lumileds Lighting Company of Irvine, Calif. Work continues in the field of LED module development, and also in the field of using LED modules for various lighting fixtures in various applications. It is the latter field to which this invention relates.

Lights using LED modules as light source for various applications present particularly challenging problems in fixture development, particularly when light mounting locations and structures will vary. Among other things, placement of the electronic LED power units (LED-drivers) for lighting fixtures using LED arrays can be particularly problematic. In some cases, keeping such electronic LED-drivers in a water/air-tight location may not be difficult, especially for indoor application, but if mounting locations and structures vary, then location and protection of such components becomes difficult and adds development costs and potential problems. Lighting-fixture adaptability is an important goal for LED lights that are often presented and mounted in different ways.

Heat dissipation is another problem for LED lights. And, the goals of dealing with heat dissipation and protection of electronic LED-drivers can often be conflicting, contrary goals.

In short, there is a significant need in the lighting industry for improved light fixtures using modular LED units—fixtures that are adaptable for a wide variety of mountings and situations, satisfy the problems associated with heat dissipation and appropriate protection of electronic LED-driver components. It is also desirable to have an lighting fixture providing greater flexibility in application. Finally, there is a need for an improved LED-module-based LED light which is easy and inexpensive to manufacture.

OBJECTS OF THE INVENTION

It is an object of the invention to provide an improved LED light fixture that overcomes some of the problems and shortcomings of the prior art, including those referred to above.

Another object of the invention is to provide an improved LED light fixture that is readily adaptable for a variety of mounting positions and situations.

Another object of the invention is to provide an improved LED light that reduces development and manufacturing costs for LED light for different light applications.

Another object of the invention is to provide an improved LED light with excellent protection of the electronic LED-drivers needed for such products.

Still another object of the invention is to provide an improved LED light with both good protection of electronic LED-drivers and excellent heat dissipation.

How these and other objects are accomplished will become apparent from the following descriptions and the drawings.

SUMMARY OF THE INVENTION

The present invention is an improvement in an LED light fixture. The inventive LED light fixture is preferably an outdoor light fixture which includes a housing having a substantially water-tight chamber which may also be air-tight; at least one electronic normal-operation LED-driver enclosed within the chamber and receiving power from a general off-location power source during normal operation; an LED assembly secured with respect to the housing, the LED assembly having at least one LED-array module preferably mounted on an LED heat sink; at least one backup battery within the chamber and being capable of providing power during a power outage; and at least one electronic backup LED-driver unit enclosed within the chamber, the backup LED-driver unit drawing battery power during an outage of power from the general off-location power source.

In the most preferred embodiment, the LED assembly has a plurality of the LED-array modules only a subset of which is being powered by the backup LED-driver unit during power outage. In some of such embodiments, the subset is a single LED-array module.

The backup LED-driver unit is preferably configured to sense whether power is being provided by the general off-location power source. In some preferred embodiments of this type, the backup LED-driver unit may also be configured to sense whether the LED light fixture has been turned off to preclude the drawing of battery power when the LED light fixture has been turned off.

In the most highly preferred embodiments of this invention, the backup LED-driver unit is further configured for charging the backup battery/batteries from the general off-location power source during normal operation. The backup LED-driver unit preferably includes a charge-level sensor for determining whether there is a need for battery charging.

In an alternative embodiment of the present invention, the LED light fixture includes at least one electronic integrated LED-driver unit enclosed within the chamber. Such integrated electronic LED-driver unit includes at least one normal operation LED-driver receiving power from a general off-location power source during normal operation, and at least one backup battery capable of providing power during a power outage. Such integrated electronic LED-driver unit can also include at least one backup LED-driver drawing battery power during a power outage.

In some highly preferred embodiments, the LED assembly is secured with respect to the housing adjacent thereto in non-water/air-tight condition. The LED-array module is preferably mounted on an LED heat sink.

The housing preferably includes substantially water/air-tight wire-access(es) receiving wires from the LED assembly into the chamber for passage of wires for connection with the driver(s) within the chamber.

In certain highly preferred embodiments the housing is a perimetrical structure such that the substantially water-tight chamber is perimetrical and substantially surrounds the LED assembly. Such housing includes a frame structure forming a frame-portion of the chamber having an opening edge thereabout, a border structure forming a border-portion of the chamber and secured to the frame structure, and has a water-tight seal between the frame structure and the border structure to maintain the water-tight condition of the chamber.

In the embodiments just described, the electronic normal-operation LED-driver(s) and the backup LED-driver unit(s) are preferably enclosed within the frame-portion of the chamber, and the backup battery/batteries is/are preferably enclosed within the border-portion of the chamber.

The frame structure forming a frame-portion of the chamber having an opening edge thereabout and at least one border structure forming a border-portion of the chamber and secured to the frame structure. The opening edge of the frame-portion of the chamber may include a groove configured for mating water/air-tight engagement with the border structure. It is highly preferred that the border structure is a metal extrusion.

It is preferred that one or more electronic normal-operation LED-drivers and one or more backup LED-drivers are enclosed in the frame-portion of the chamber, and one or more backup battery/batteries is/are enclosed within the border-portion of the chamber.

In highly preferred embodiments of this invention the housing includes a water/air-tight seal between the frame structure and the border structure to maintain the water/air-tight condition of the chamber. The border structure preferably has at least one end configured for sealing engagement with respect to the opening edge of the frame structure. It is preferred that there is a gasket between the border structure end and the opening edge of the frame structure.

In certain preferred embodiments of this invention the frame-portion of the chamber preferably includes walls terminating at an open end and a removable cover-plate in substantially water/air-tight sealing engagement with the open end. The cover-plate preferably includes at least a part of the opening edge of the frame structure. The border structure preferably has at least one end configured for sealing engagement with respect to the opening edge of the frame structure. It is preferred that there is a gasket between the border structure end and the opening edge of the frame structure.

In some preferred embodiments of the outdoor LED light fixture of this invention, the water/air-tight chamber has two portions. A first portion preferably enclosing the electronic normal-operation LED-driver(s) and backup LED-drivers, and at least one second portion preferably enclosing the backup battery/batteries. The first portion and the at least one second portion preferably each form separate enclosures.

In certain highly preferred embodiments of this invention, including those used for street lighting and the like, the housing is a perimetrical structure such that the substantially water/air-tight chamber in perimetrical and substantially surrounds the LED assembly. The housing preferably includes a pair of opposed frame structures and a pair of opposed border structures. The perimetrical structure is preferably substantially rectangular.

It is preferred that there are two or more of the backup batteries, at least one in each of the border structures.

The term "perimetrical structure" as used herein means an outer portion of the fixture which completely or partially surrounds remaining portions of the fixture. In certain preferred embodiments, such as those most useful for road-way lighting and the like, the perimetrical structure preferably completely surrounds remaining portions of the fixture. In certain other cases, such as certain wall-mounted light fixtures, the perimetrical structure partially surrounds the remaining portions of the fixture.

In certain preferred embodiments the frame structure preferably includes a vent permitting air flow to and from the LED assembly. Such venting facilitates cooling the LED assembly.

In some preferred embodiments, the border structure has at least one bolt-receiving border-hole through the border structure, such border-hole being isolated from the border-portion of the chamber. The frame structure also has at least one bolt-receiving frame-hole through the frame structure, the frame-hole being isolated from the frame-portion of the chamber. Each such one or more frame-holes are aligned with a respective border-hole(s). A bolt passing through each aligned pair of bolt-receiving holes such that the border structure and the frame structure are bolted together while maintaining the water/air-tight condition of the chamber.

In certain preferred embodiments of the inventive LED light fixture, the LED assembly includes a plurality of LED-array modules each separately mounted on its corresponding LED heat sink, the LED heat sinks being interconnected to hold the LED-array modules in fixed relative positions. Each heat sink preferably includes: a base with a back surface, an opposite surface, two base-ends and two opposite sides, one of the LED modules being against the back surface; a female side-fin and a male side-fin, one along each of the opposite sides and each protruding from the opposite surface to terminate at a distal fin-edge, the female side-fin including a flange hook positioned to engage the distal fin-edge of the male side-fin of an adjacent heat sink; and at least one inner-fin protruding from the opposite surface between the side-fins. In some embodiments of this invention, there may be a plurality of inner-fins. Each heat sink preferably includes a lateral recess and a lateral protrusion, one at each of the opposite sides of the base, the recess and the protrusion being positioned and configured for mating engagement of the protrusion of one heat sink with the recess of the adjacent heat sink when the heat sinks are in proper alignment. The flange hook may be at the distal fin-edge of the female side-fin.

In some embodiments of this invention, each heat sink may also include first and second lateral supports protruding from the back base-surface, each of the lateral supports having an inner portion and an outer portion. The inner portions of such first and second lateral supports may have first and second opposed ledges, respectively, which form a passageway slidably supporting one of the LED modules against the back surface of the base. The first and second supports of each heat sink are preferably in substantially planar alignment with the side-fins, respectively.

It is highly preferred that each heat sink be a metal extrusion with the back base-surface of such heat sink being substantially flat to facilitate heat transfer from the LED-array module, which itself has a flat surface against the back-base surface.

In certain of the above preferred embodiments, the side-fins are each a continuous wall extending along the first and second base-sides, respectively. It is further preferred that the inner-fin(s) is/are also continuous wall(s) extending along the base. The inner-fin(s) can be substantially parallel to the side-fins.

Some of such preferred embodiments preferably include an interlock of the perimetrical structure to the LED assembly. In each heat sink, at least one of the inner-fins is a middle-fin including a fin-end forming a mounting hole receiving a coupler having a coupler-head; and the interlock is a slotted cavity engaging the coupler-head within the slotted cavity. The slotted cavity preferably extends along the border structure and the coupler-head extends from the heat sink of the LED assembly.

In some versions of the inventive LED light fixture, the perimetrical structure includes a pair of the border structures configured for wall mounting and one of the frame structures in substantially perpendicular relationship to each of the border structures.

In the aforementioned substantially rectangular versions of this invention, in which the perimetrical structure includes a pair of opposed frame structures and a pair of opposed border structures, one of the border structures or the frame structures includes a passage in communication with a fixture-mounting assembly.

Such fixture-mounting assembly preferably includes a fixture-support member and a surface-attachment member, wherein the fixture-support member has proximal and distal ends and includes walls defining a compartment, a first opening at the proximal end for communication with the surface-attachment member, and a second opening at the distal end for communication with the passage of the light fixture.

In some embodiments, the fixture-mounting assembly is a fixed mounting configured for securing the light fixture to a fixed surface. In such embodiments the fixture-support member preferably has a neck portion which extends from the proximal end and has a flange portion extending therefrom, and the surface-attachment member includes a proximal end attachable to the fixed surface and a distal end configured to engage the neck portion, whereby the fixture-support member is supported by the surface-attachment member when the neck portion is engaged with the fixture-support member.

In alternative embodiments, the fixture-mounting assembly is an adjustable mounting configured for securing the light fixture to a pole. In such embodiments the fixture-support member includes a fixture-adjustment portion which extends from the proximal end, and the surface-attachment member includes a proximal end configured for secure engagement with the pole and a distal end having a pole-adjustment portion rotatably engaging the fixture-adjustment portion. Such adjustable fixture-mounting assembly permits up to 180° angle in positioning of the lighting fixture with respect to the pole.

In the above-described embodiments, the fixture-support member is preferably connected to the light fixture via a clamp. The clamp is preferably U-shaped. It is further preferred that there is a gasket between the light fixture and the fixture-support member.

In some other alternative embodiments of the aforementioned substantially rectangular versions of this invention, in which the perimetrical structure includes a pair of opposed frame structures and a pair of opposed border structures, one of the border structures includes two sub-portions with a gap therebetween. The sub-portions each include all of the border-portion elements. The gap accommodates a pole-mounting assembly, hereafter described, secured to the LED assembly between the border sub-portions.

Such pole-mounting assembly preferably includes a pole-attachment portion for receiving and securing a pole and a substantially water/air-tight section enclosing electrical connections and having at least one wire-aperture. Each wire-aperture communicates with the border-portion chamber of a respective one of the border-structure sub-portions. The border-structure sub-portion(s) are in water/air-tight engagement with the water/air-tight section of the pole-mounting assembly. The pole-attachment portion preferably includes grooves on its opposite sides, the grooves being configured for mating engagement with end edges of the border-structure sub-portions. Preferably, such pole-mounting assembly has a mounting plate abutting the LED assembly, and at least one fastener/coupler extends from the mounting plate for engagement with the mounting hole of the middle-fin(s).

In some LED light fixtures of this invention, the frame-portion of the chamber has a chamber-divider across the chamber, such chamber-divider having a divider-edge. The chamber-divider divides the frame-portion of the chamber into an end part and a main part that encloses the electronic LED-driver(s). The chamber-divider preferably includes a substantially water/air-tight wire-passage therethrough. The wire-passage is preferably a notch having spaced notch-wall ends that terminate at the divider-edge. A notch-bridge spans the notch to maintain the water/air-tight condition of the chamber. The notch-bridge preferably includes a bridge-portion and a pair of gripping-portions configured for spring-grip attachment to the notch-wall ends. Preferably, a removable cover-plate seals the main part of the frame-portion of the chamber in substantially water/air-tight condition.

Some of the inventive LED light fixtures include a protective cover extending over the LED assembly and secured with respect to the housing. Such protective cover preferably has perforations permitting air/water-flow therethrough for access to and from the LED assembly.

It is most highly preferred that the LED light fixture has a venting gap between the perimetrical structure and the LED assembly to permit water/air-flow from the heat sink. The venting gap may be formed by an interlock of the perimetrical structure to the LED assembly.

The improved LED light fixture of this invention overcomes the problems discussed above. Among other things, the invention provides substantially water/air-tight enclosure of electronic LED-drivers and backup batteries inside the fixture, while still accommodating heat-dissipation requirements for the LED assembly. And, the fixture of this invention is both adaptable for varying applications and mountings, and relatively inexpensive to manufacture.

The term "general power source" as used herein means a power regularly supplied by an electric company and communicating electric energy to lighting fixtures and other electric equipment via general power-lines. Alternatively, "general power source" may refer to a generator or a similar type of apparatus regularly supplying an industrial, commercial or other type of object with electric energy necessary to power lighting fixtures and other equipment.

The term "off-location" as used herein with respect to a power source means a power source located away from a light fixture such that the power is communicated to the fixture from the outside external wires or other type of external power communication.

The term "backup LED-driver unit" as used herein means an electronic apparatus that includes at least an LED driver, but also preferably includes (1) a power-outage sensor to determine whether or not power is being provided by the general off-location power source, (2) an "on-off" sensor to determine whether the LED light fixture has been turned off and to preclude the drawing of battery power when the LED light fixture has been turned off, (3) a charge-level sensor for determining whether or not there is a need for battery charging and responding to the need for battery charging determined by the charge-level sensor, and (4) a power-switching device responsive to a power outage when the "on-off" sensor indicates that the fixture is "on" and responsive to a restoration of general power sensor.

The term "power outage" as used herein means absence of power from the general off-location power source.

The term "battery" as used herein means a device holding charge sufficient to power an LED module.

DETAILED DESCRIPTION OF PREFERRED EMBODIMENTS

Figure 1:
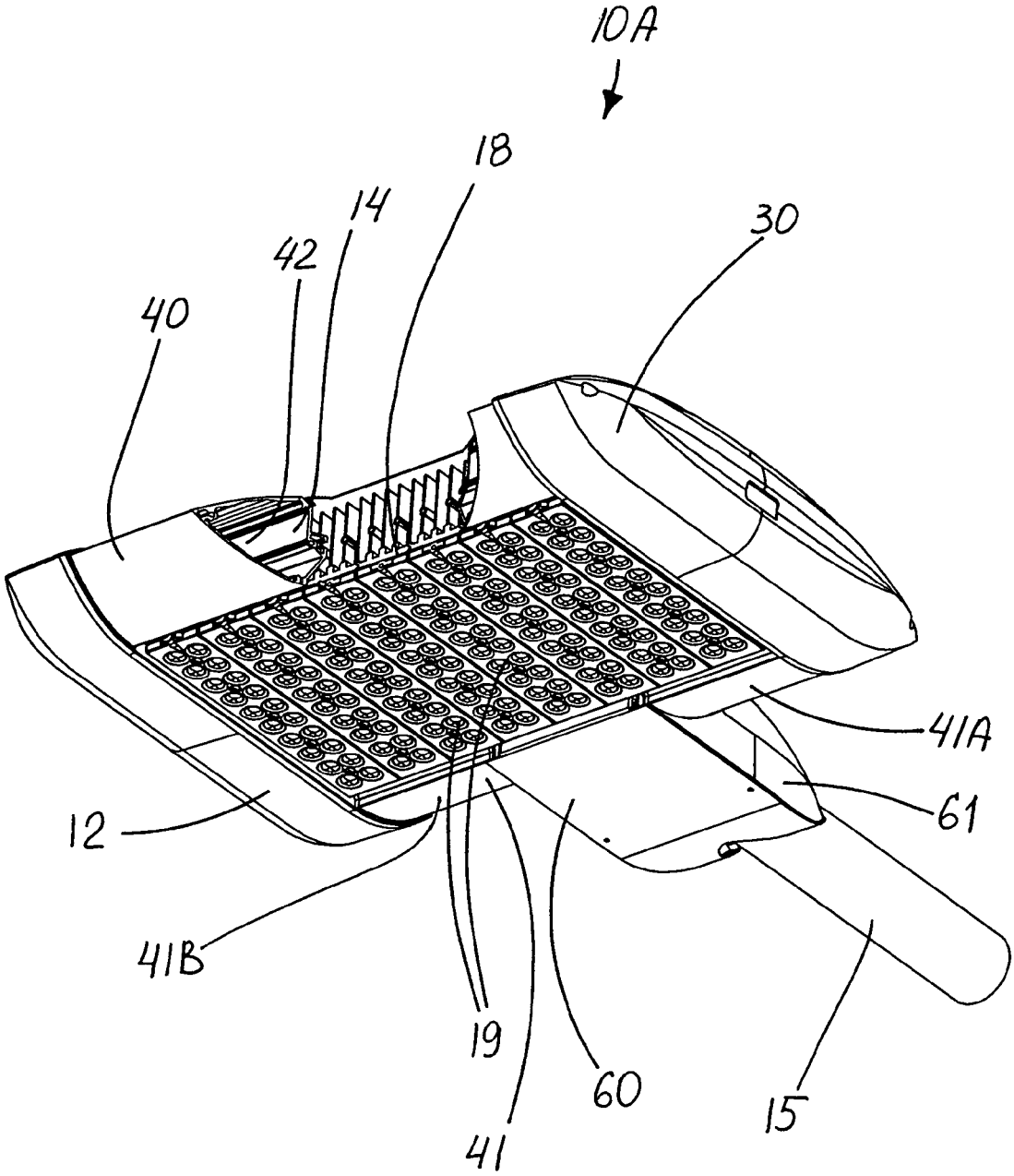
FIG. 1 is a perspective view of an LED floodlight fixture in accordance with this invention, including a cut-away portion showing an LED assembly.

FIGS. 1-11 illustrate LED light fixtures 10A and 10B (the latter in FIG. 2 only) in accordance with this invention. Common or similar parts are given the same numbers in the drawings of both embodiments, and the light fixtures are often referred to by the numeral 10, without the A or B lettering used in the drawings, and in the singular for convenience.

Floodlight fixture 10 includes a perimetrical structure 12 that forms a substantially water/air-tight chamber 14, at least one electronic LED-driver 16 which is enclosed within chamber 14, and an LED assembly 18 that is secured with respect to perimetrical structure 20 adjacent thereto in non-water/air-tight condition. LED assembly 18 has a plurality of LED-array modules 19 each secured to an LED heat sink 20.

Figure 7:
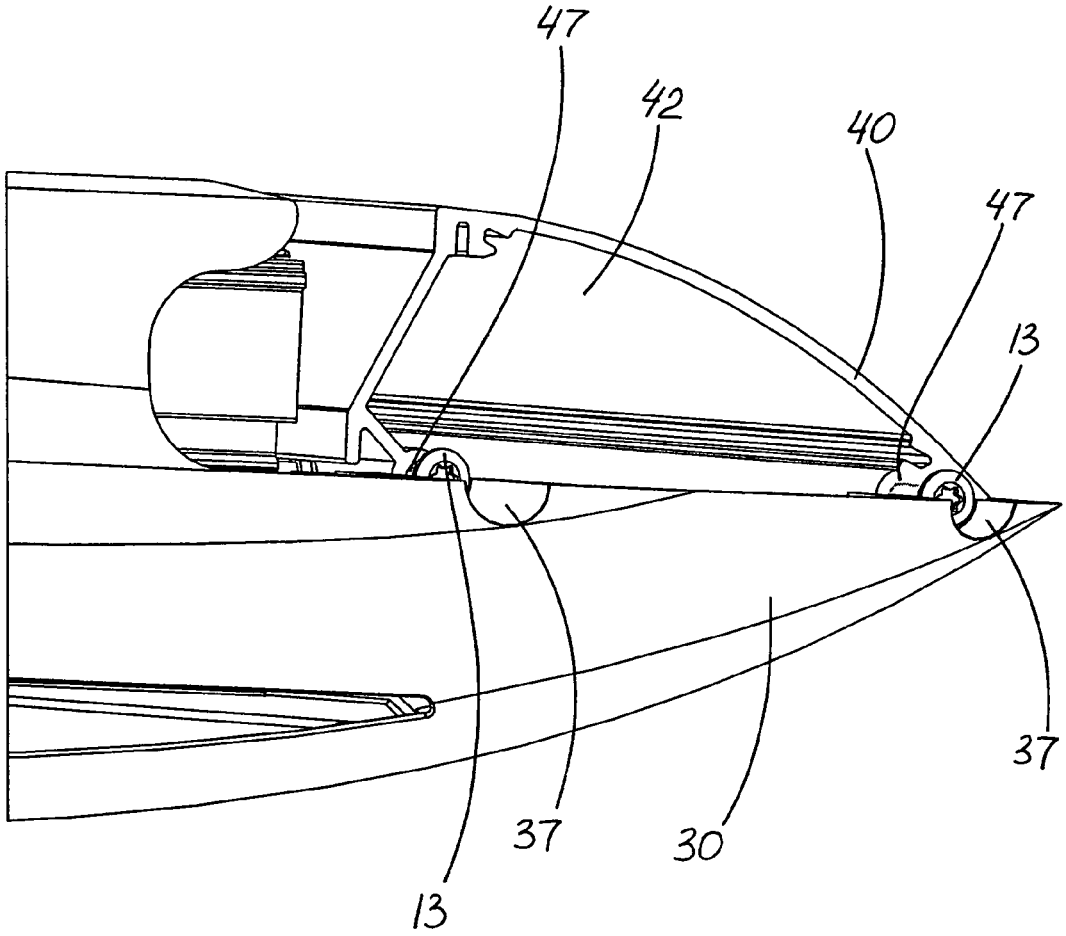
FIG. 7 is another fragmentary perspective view showing the frame structure in partially transparent view to illustrate its being bolted together with the border structure.

As seen in FIGS. 1-4 and 7, perimetrical structure 12 includes a frame structure 30 forming a frame-portion 32 of chamber 14 with an opening edge 34 thereabout and a border structure, also referred to as a nose structure, 40 secured to frame structure 30 and forming a border-portion (or a nose-portion) 42 of chamber 14. As best seen in FIG. 7, opening edge 34 of frame-portion 30 of chamber 14 includes a groove 35 configured for mating water/air-tight engagement with border structure 40. Border structure 40 is an extrusion, preferably of aluminum. FIG. 5 shows electronic LED-drivers 16 enclosed in frame-portion 32 of chamber 14.

Figure 6:
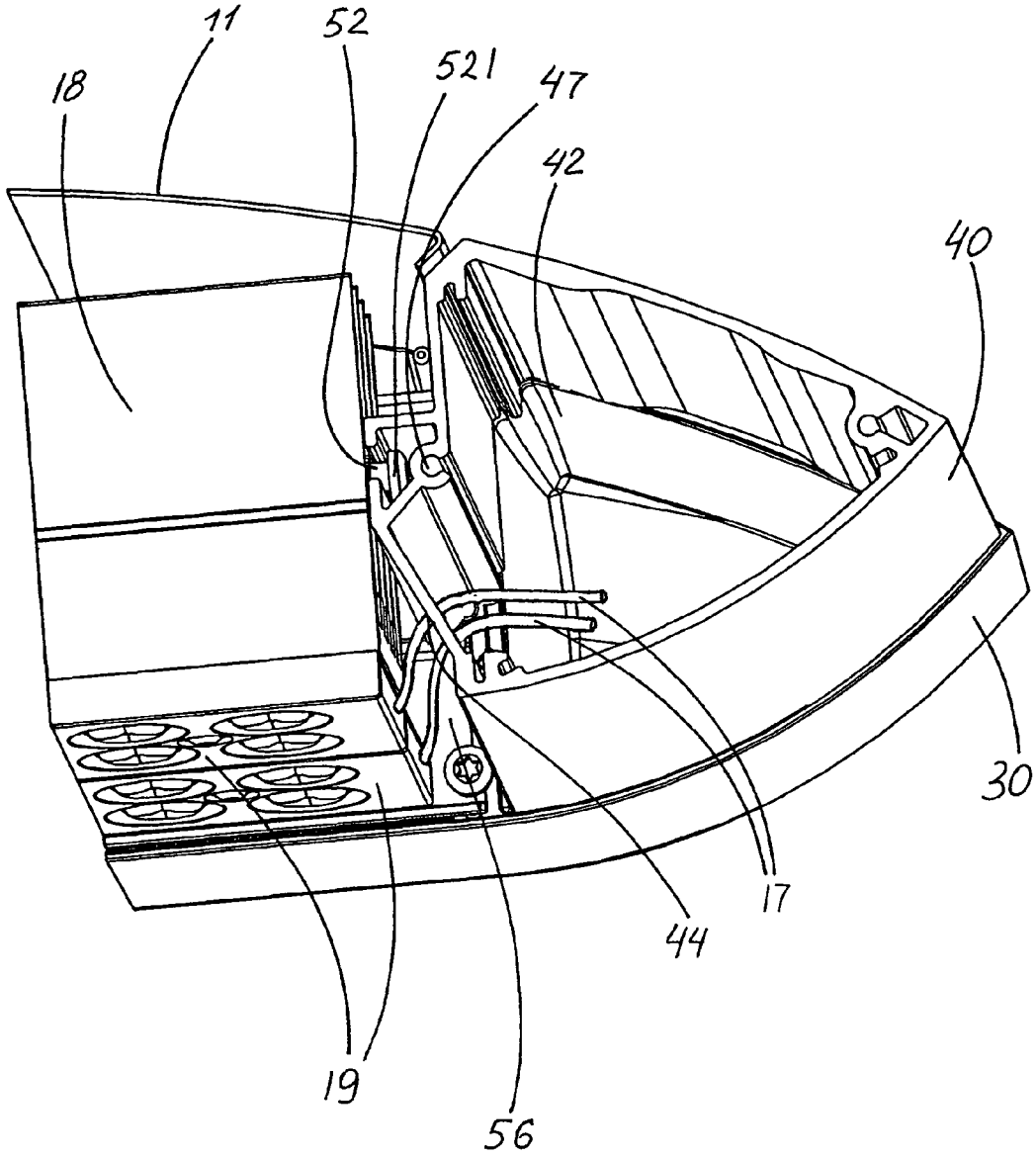
FIG. 6 is an enlarged fragmentary view the right portion of FIG. 4.

As best seen in FIG. 6, border structure 40 includes substantially water/air-tight wire-accesses 44 for passage of wires 17 between LED assembly 18 and water/air-tight chamber 14.

FIGS. 2, 3, 5 and 7 show that frame structure 30 includes a vent 36 permitting air flow to and from LED assembly 18. Vent 36 facilitates cooling of LED assembly 18.

As best illustrated in FIG. 7, border structure 40 has bolt-receiving border-holes 47 therethrough which are isolated from border-portion 42 of chamber 14. And, frame structure 30 has bolt-receiving frame-holes 37 therethrough which are isolated from frame-portion 32 of chamber 14; each frame-hole 37 is aligned with a respective border-hole 47. A bolt 13 passes through each aligned pair of bolt-receiving holes 37 and 47 such that border structure 40 and frame structure 30 are bolted together while maintaining the water/air-tight condition of chamber 14.

Figure 3:
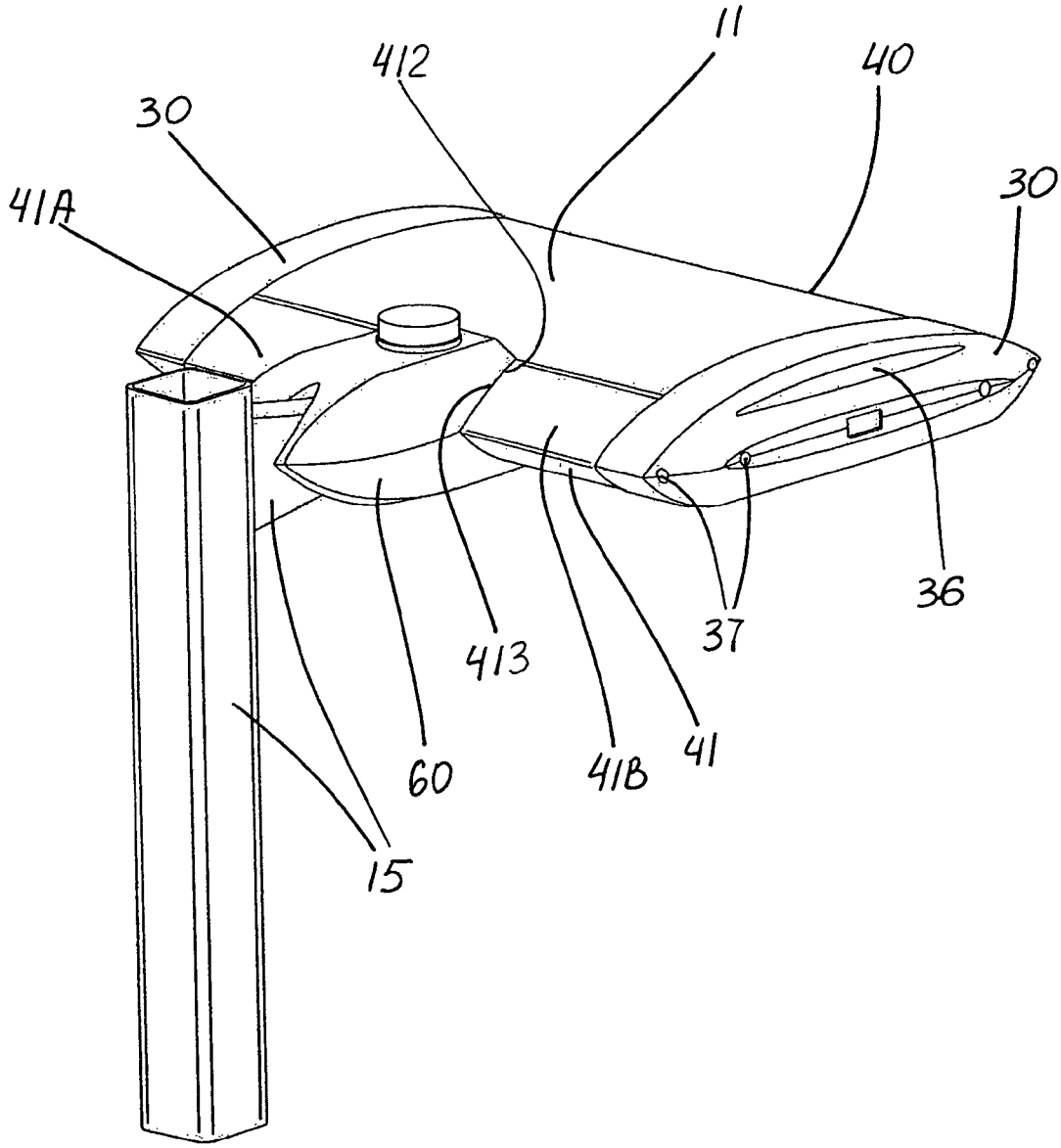
FIG. 3 is a perspective view of another LED light fixture including a pole-mounting assembly on a pole of square cross-section.

FIGS. 1 and 3 best illustrate certain highly preferred embodiments of this invention in which perimetrical structure 12 includes a pair of opposed frame structures 30 and a pair of opposed border structures 40, making perimetrical structure 12 of floodlight fixture 10A substantially rectangular. FIGS. 1, 4-6, 8 and 11 illustrate aspects of inventive LED floodlight fixture 10A.

Figure 10:
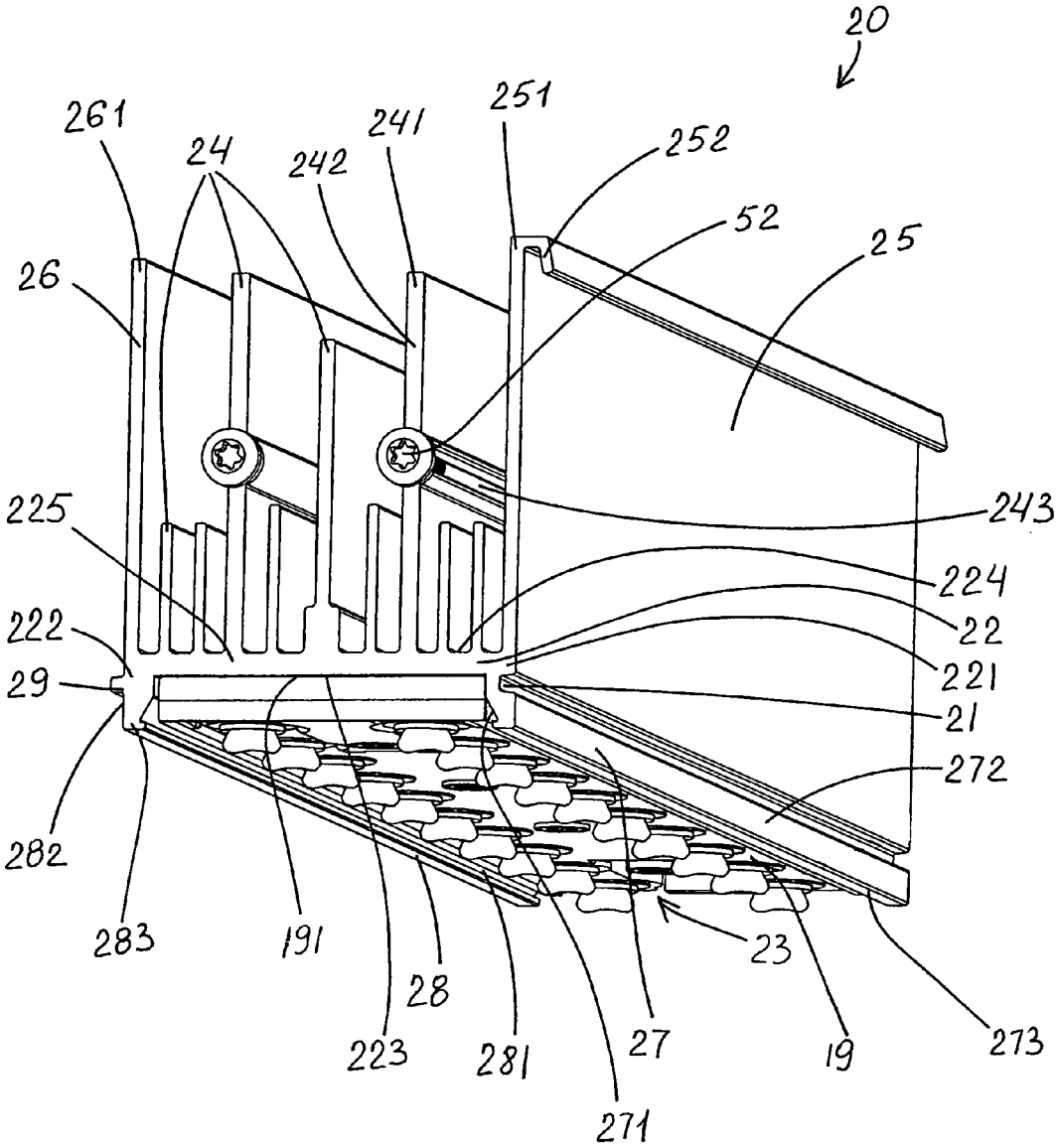
FIG. 10 is an enlarged fragmentary perspective view of one LED-array module LED and its related LED heat sink of the LED assembly of the illustrated LED light fixtures.
Figure 11:
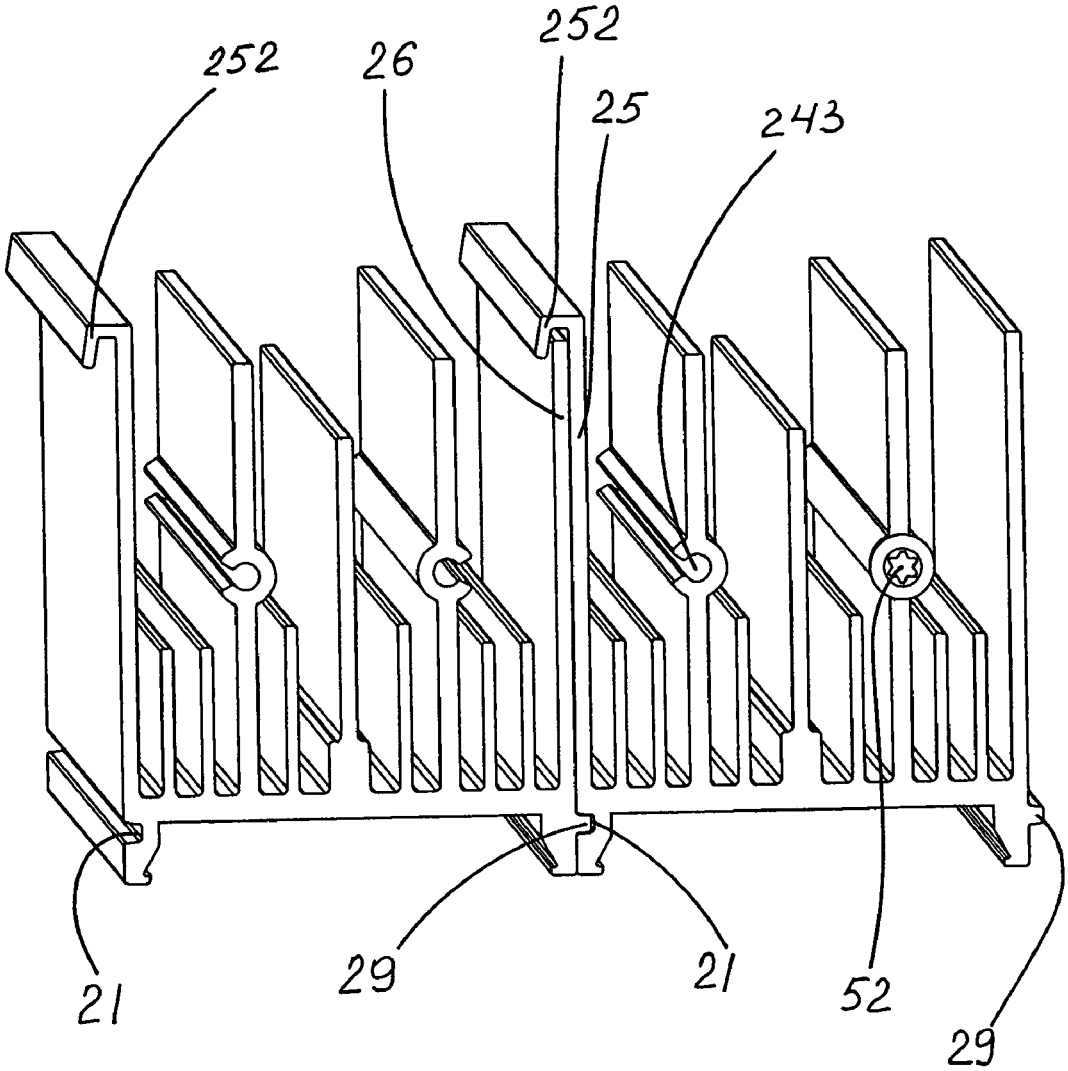
FIG. 11 is an enlarged fragmentary end-wise perspective view of two interconnected LED heat sinks of the LED assembly of the illustrated LED light fixtures.

In LED floodlight fixtures 10, LED assembly 18 includes a plurality of LED-array modules 19 each separately mounted on its corresponding LED heat sink 20, such LED heat sinks 20 being interconnected to hold LED-array modules 19 in fixed relative positions. Each heat sink 20 includes: a base 22 with a back base-surface 223, an opposite base-surface 224, two base-ends 225 and first and second base-sides 221 and 222; a plurality of inner-fins 24 protruding from opposite base-surface 224; first, female, and second, male, side-fins 25 and 26 protruding from opposite base-surface 224 and terminating at distal fin-edges 251 and 261, female side-fin 25 including a flange hook 252 positioned to engage distal fin-edge 261 of male side-fin 26 of adjacent heat sink 20; and first and second lateral supports 27 and 28 protruding from back base-surface 223, lateral supports 27 and 28 each having inner portions 271 and 281, respectively, and outer portion 272 and 282, respectively. Inner portions 271 and 281 of first and second lateral supports 27 and 28 have first and second opposed support-ledges 273 and 283, respectively, that form a heat-sink-passageway 23 which slidably supports an LED-array module 19 against back base-surface 223. First and second supports 27 and 28 of each heat sink 20 are in substantially planar alignment with first and second side-fins 25 and 26, respectively. As seen in FIGS. 10 and 11, the flange hook is at 251 distal fin-edge of first side-fin 25.

Each heat sink 20 is a metal (preferably aluminum) extrusion with back base-surface 223 of heat sink 20 being substantially flat to facilitate heat transfer from LED-array module 19, which itself has a flat surface 191 against back-base surface 223. Each heat sink 20 also includes a lateral recess 21 at first base-side 221 and a lateral protrusion 29 at second base-side 222, recesses 21 and protrusions 29 being positioned and configured for mating engagement of protrusion 29 of one heat sink 20 with recess 21 of adjacent heat sink 20.

As best seen in FIGS. 1, 4, 5, 6, 10 and 11, first and second side-fins 25 and 26 are each a continuous wall extending along first and second base-sides 221 and 222, respectively.

Inner-fins 24 are also each a continuous wall extending along base 22. Inner-fins 24 are substantially parallel to side-fins 25 and 26.

Figure 4:
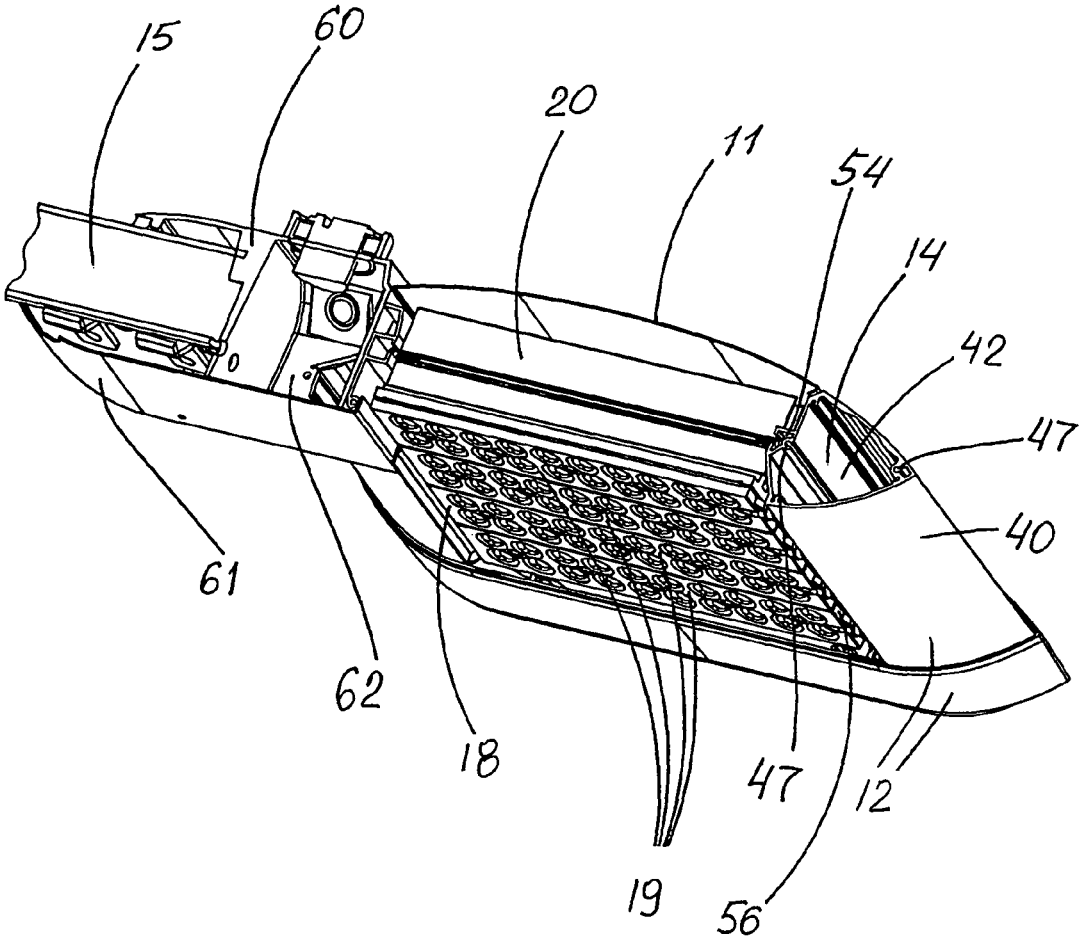
FIG. 4 is a side perspective view of the LED light of FIG. 1 broken away at a middle portion to show interior structure.
Figure 5:
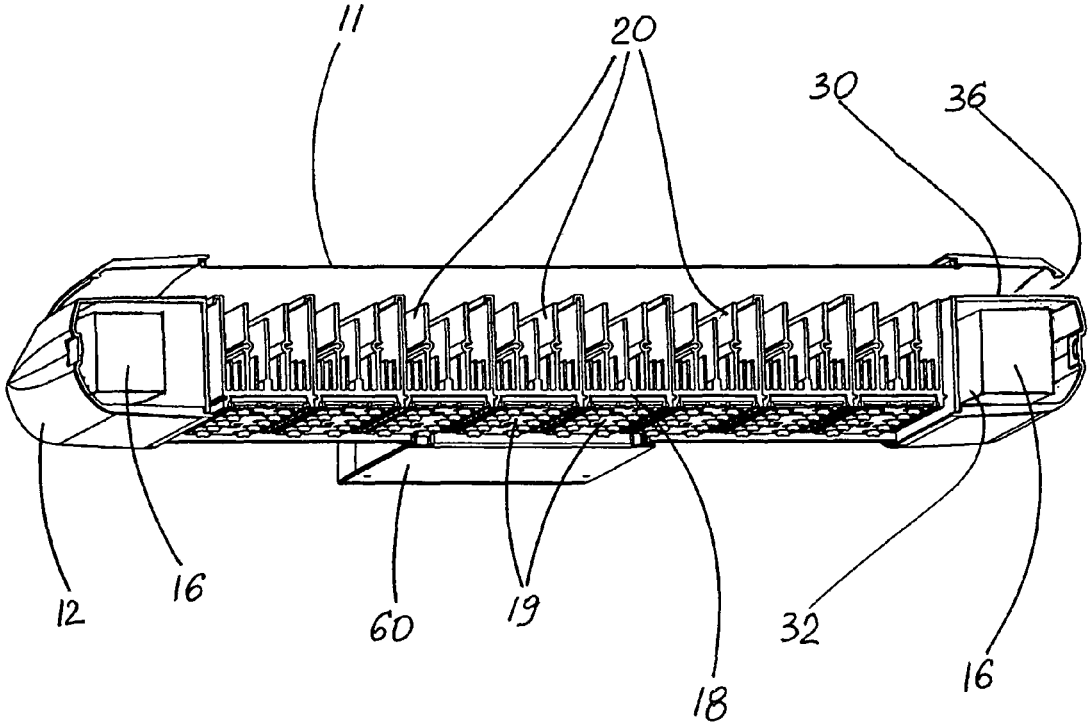
FIG. 5 is a front perspective view of the LED floodlight of FIG. 1 broken away at a middle portion to show interior structure.

FIGS. 4 and 6 show an interlock of perimetrical structure 12 to LED assembly 18. As also seen in FIGS. 4 and 6, in each heat sink 20 inner-fins 24 include two middle-fins 241 each of which includes a fin-end 242 forming a mounting hole 243. A coupler 52 in the form of screw is engaged in mounting hole 243, and extends from heat sink 20 to terminate in a coupler-head 521. Perimetrical structure 12 has a slotted cavity 54 which extends along, and is integrally formed with, each of the border structures 40 and forms the interlock by receiving and engaging coupler-heads 521 therein.

Figure 2:
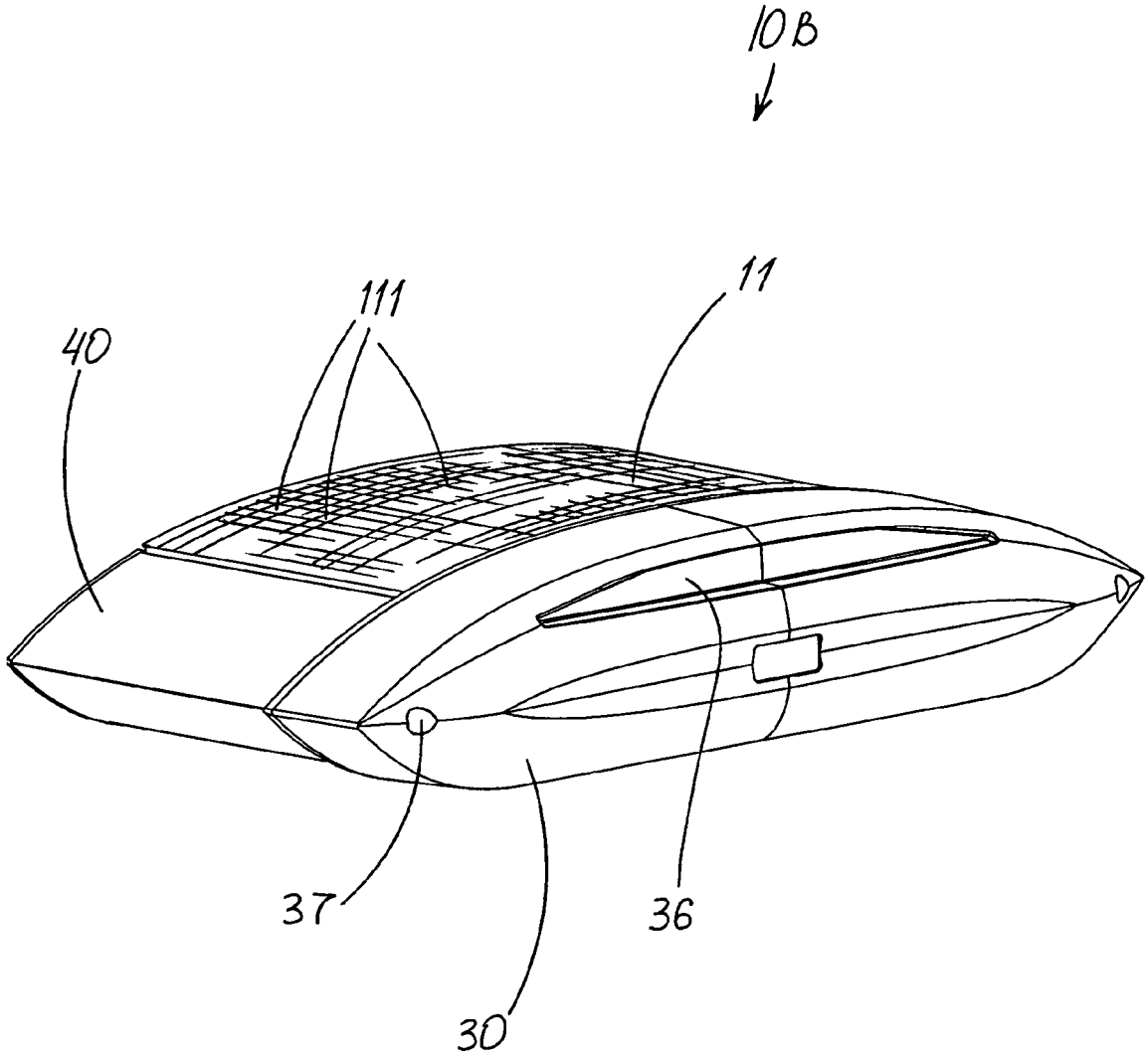
FIG. 2 is a perspective view of the LED light fixture configured for wall mounting.

FIG. 2 illustrates a version of the invention which, as noted above, is LED floodlight fixture 10B. In floodlight fixture 10B, perimetrical structure 12 includes a pair of nose structures 40 configured for wall mounting and one frame structure 30 in substantially perpendicular relationship to each of the two nose structures 40.

The substantially rectangular floodlight fixture 10A which is best illustrated in FIGS. 1, 3 and 4, perimetrical structure 12 includes a pair of opposed frame structures 30 and a pair of opposed nose structures 40 and 41, the latter nose portion having two spaced sub-portions 41A and 41B with a gap 412 therebetween. Sub-portions 41A and 41B each include all of the nose-portion elements. Gap 412 accommodates a pole-mounting assembly 60, shown in FIGS. 1, 3, 4 and 12, that is secured to LED assembly 18 between nose sub-portions 41A and 41B.

Pole-mounting assembly 60 includes a pole-attachment portion 61 that receives and secures a pole 15 and a substantially water/air-tight section 62 that encloses electrical connections and has wire-apertures 64. Each wire-aperture 64 communicates with nose-portion 42 of chamber 14 of a respective one of nose-structure sub-portions 41A and 41B. The nose-structure sub-portions 41A and 41B are in water/air-tight engagement with water/air-tight section 62 of pole-mounting assembly 60. Pole-attachment portion 61 includes grooves 611 on its opposite sides 612; grooves 611 are configured for mating engagement with end edges 413 of nose-structure sub-portions 41A and 41B.

Figure 12:
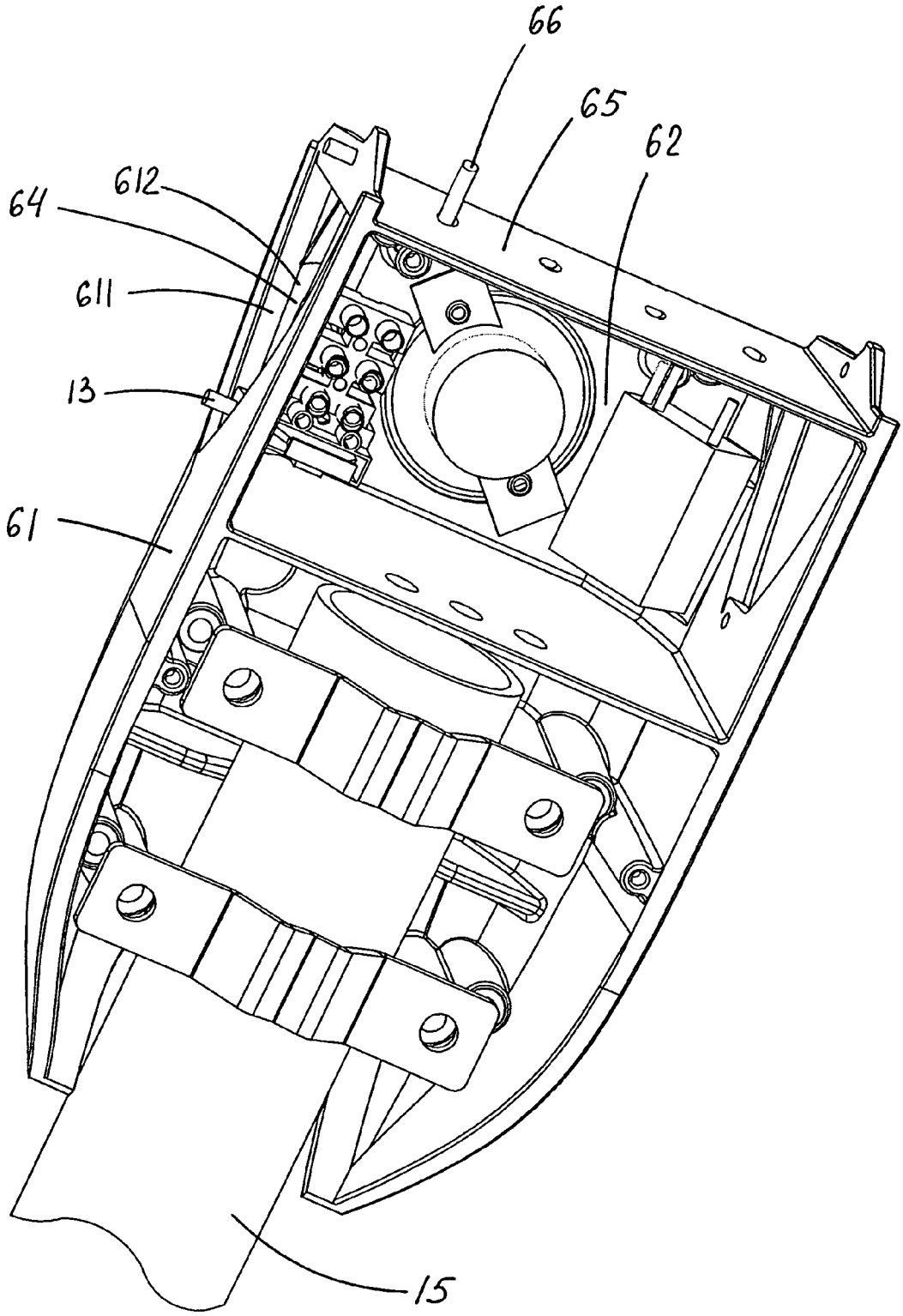
FIG. 12 is an enlarged fragmentary perspective view from below of the pole-mounting assembly engaged with a pole-attachment portion, with the cover of the pole-mounting assembly removed to show internal parts.

As best seen in FIG. 12, pole-mounting assembly 60 has a mounting plate 65 abutting LED assembly 18, and fastener/couplers 66 extend from mounting plate 65 into engagement with mounting hole 243 of middle-fins 241.

Figure 8:
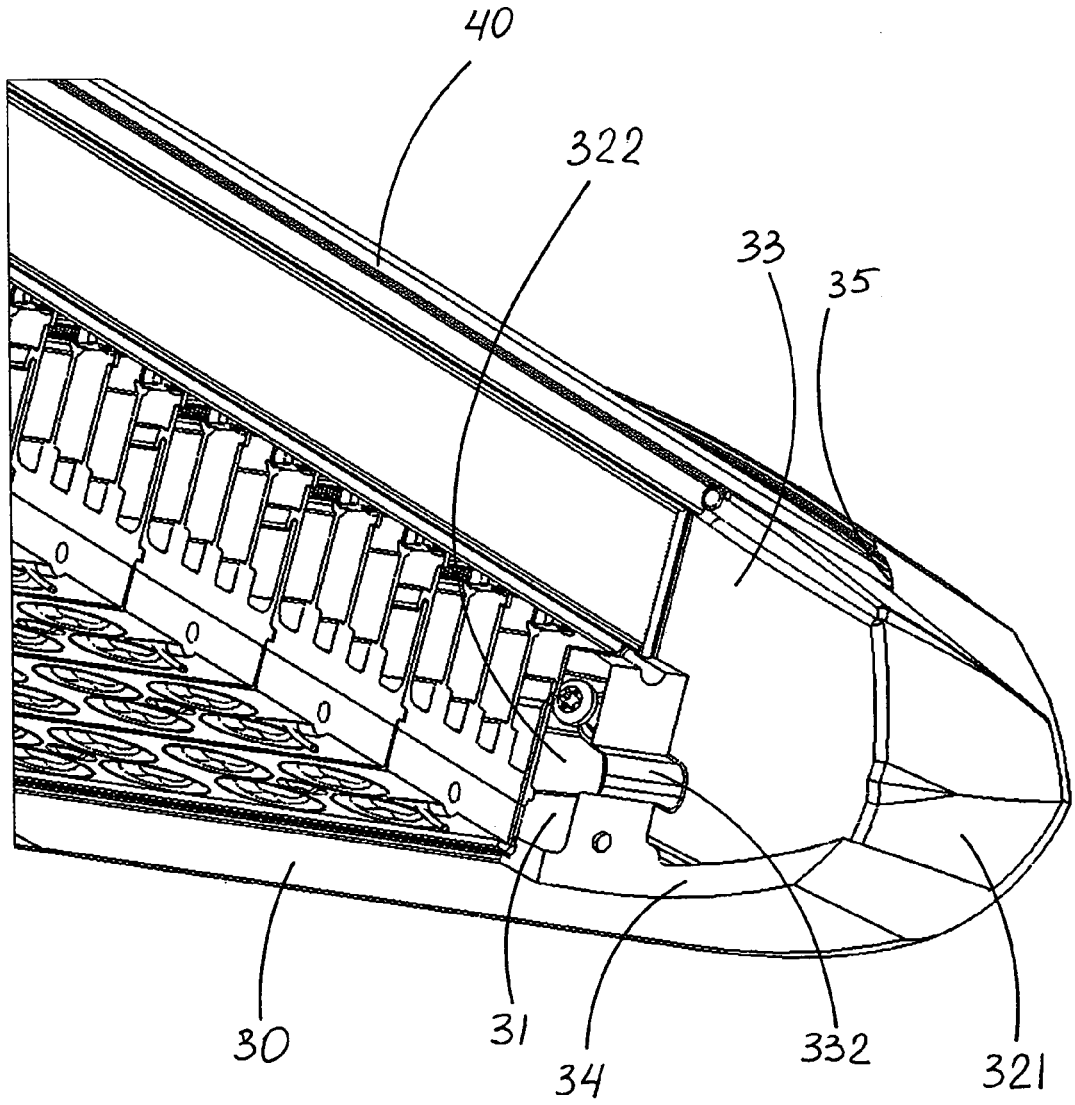
FIG. 8 is another fragmentary perspective view showing the border structure in partially transparent view to illustrates its engagement with the frame structure.
Figure 9:
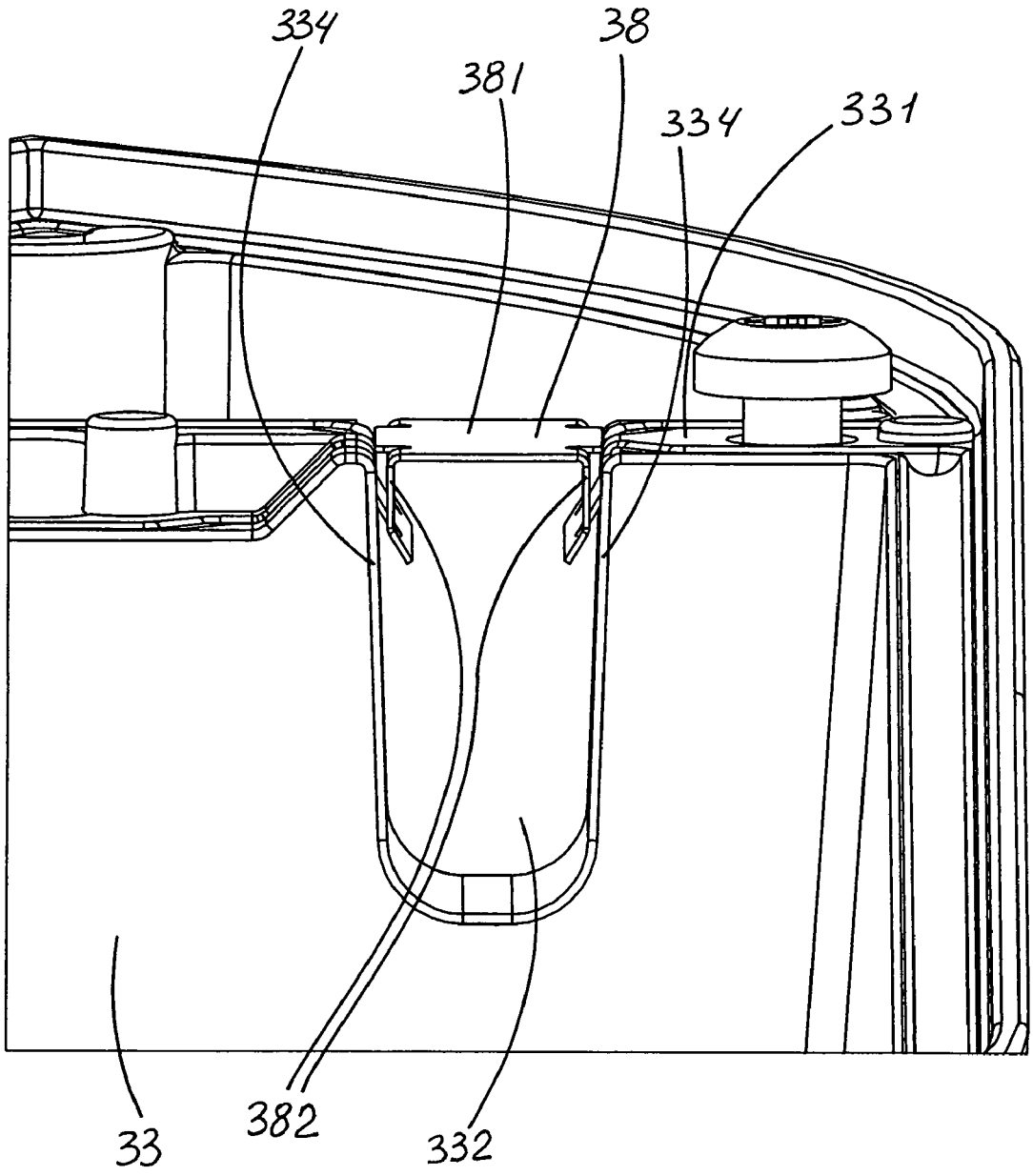
FIG. 9 is a greatly enlarged fragmentary perspective view showing a portion of the chamber-divider wall, the notch therein and the notch-bridge thereover.

FIGS. 8 and 9 show that frame-portion 32 of chamber 14 has a chamber-divider 33 across chamber 32 that divides frame-portion 32 of chamber 14 into an end part 321 and a main part 322, which encloses electronic LED-driver(s) 16. Chamber-divider 33 has a divider-edge 331. Chamber-divider 33 includes a substantially water/air-tight wire-passage therethrough in the form of a notch 332 having spaced notch-wall ends 334 that terminate at divider-edge 331. A notch-bridge 38 spans notch 332 to maintain the water/air-tight condition of chamber 32. Notch-bridge 38 includes a bridge-portion 381 and a pair of gripping-portions 382 which are configured for spring-grip attachment to notch-wall ends 334. A removable cover-plate 31 seals main part 322 of frame-portion 32 of chamber 14 in substantially water/air-tight condition.

FIGS. 2-6 show that inventive LED floodlight fixtures 10 include a protective cover 11 that extends over LED assembly 18 and is secured with respect to perimetrical structure 12. Protective cover 11 has perforations 111 to permit air and water flow therethrough for access to and from LED assembly 18.

As best seen in FIG. 6, LED floodlight fixture 10 has a venting gap 56 between perimetrical structure 12 and LED assembly 18, to permit air and water flow from heat sink 20. Venting gap 56 is formed by interlock 50 of perimetrical structure 12 to LED assembly 18.

A significant factor in designing lighting fixtures is continuous illumination of such areas as parking lots, parking structures or walkways. The lighting fixtures have to be designed to emit light even when the general utility-type power supply is interrupted.

Traditional designs, however, present multiple problems which result in complicated lighting schemes, higher cost of lighting fixtures and reduced or even complete absence of illumination of some outdoor areas during general power outage due to lack or disconnection of the emergency power source.

Figure 13:
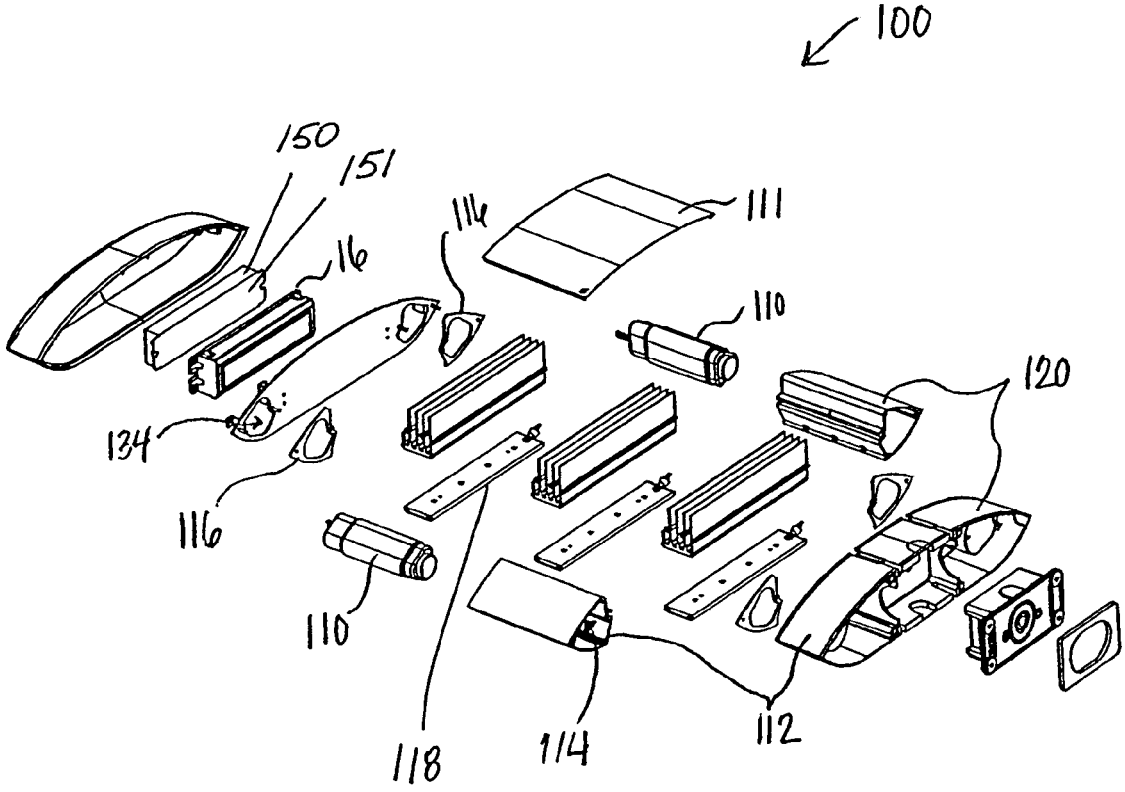
FIG. 13 is an exploded top perspective view of the LED light fixture showing backup batteries enclosed within border-portion of a water/air-tight chamber.

FIG. 13 shows a light fixture 100 which is the most highly preferred embodiment of this invention. LED light fixture 100 includes a housing 112 having a substantially water/air-tight chamber 114; at least one electronic normal-operation LED-driver 16 enclosed within chamber 114, normal operation LED-driver 16 receiving power from a general off-location power source during normal operation; LED assembly 118 secured with respect to housing 112 adjacent thereto in non-water/air-tight condition, LED assembly 118 having at least one LED-array module 19 mounted on LED heat sink 120; at least one backup battery 110 within chamber 114, battery 110 is capable of providing power thereto during an outage of power from the general off-location power source 160; and an electronic backup LED-driver unit 150 enclosed within chamber 114, backup LED-driver unit 150 drawing power from backup battery 110 during power outage.

Figure 14:
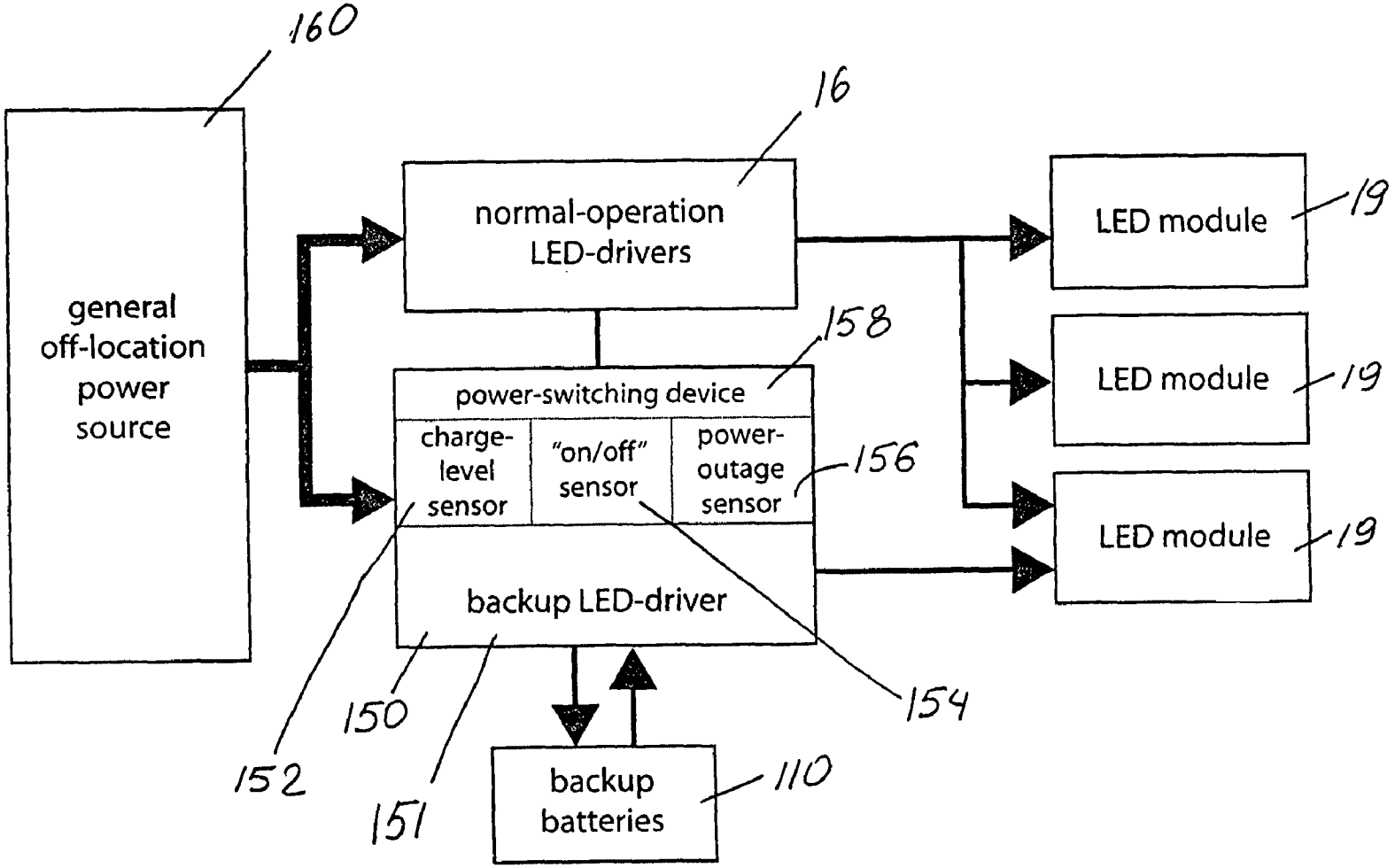
FIG. 14 is a schematic diagram of the power and control system of the LED light fixture of this invention.

FIG. 14 schematically shows power and control system of the most preferred embodiment of the present invention. Backup LED-driver unit 150 is preferably configured to sense whether power is being provided by the general off-location power source. Backup LED-driver unit 150 preferably includes an a power-outage sensor to determine whether or not power is being provided by the general off-location power source 160. In some preferred embodiments of this type, the backup LED-driver unit may also be configured to sense whether the LED light fixture has been turned off to preclude the drawing of battery power when the LED light fixture has been turned off. Backup LED-driver unit 150 preferably includes an on-off sensor 154 determine whether the LED light fixture has been turned off and to preclude the drawing of battery power when the LED light fixture has been turned off. Backup LED-driver unit 150 also preferably including a power-switching device 158 responsive to a power outage when the "on-off" sensor indicates that the fixture is "on" and responsive to a restoration of general power sensor.

In the most highly preferred embodiment illustrated in FIG. 14, backup LED-driver unit 150 is further configured for charging backup batteries 110 from general off-location power source 160 during normal operation. Backup LED-driver unit 150 preferably includes a charge-level sensor 152 for determining whether there is a need for battery charging.

Housing 112 preferably includes substantially water/air-tight wire-access(es) 144 receiving wires 17 from LED assembly 118 into chamber 114 for passage of wires 17 for connection with drivers 16 and 151 within chamber 114.

Housing 112 further preferably includes a frame structure 130 forming a frame-portion 132 of chamber 114 having an opening edge 134 thereabout and a border structure 140 forming a border-portion 142 of chamber 114 and secured to frame structure 130.

Housing 112 includes a water/air-tight seal between frame structure 130 and border structure 140 to maintain the water/air-tight condition of chamber 114. Border structure preferably has at least one end 144 configured for sealing engagement with respect to opening edge 134 of frame structure 130. A gasket 116 is between border structure end 144 and opening edge 134 of frame structure 130.

Frame-portion 132 of chamber 114 includes walls 136 terminating at an open end 138 and a removable cover-plate 131 in substantially water/air-tight sealing engagement with open end 138. As seen in FIG. 13, cover-plate 131 includes opening edge 134 of frame structure 130.

FIG. 13 further shows that housing 112 is a substantially rectangular perimetrical structure 121 including a pair of opposed frame structures 130 and a pair of opposed border structures 140. There are two of backup batteries 110, one in each of border structures 140.

While the principles of the invention have been shown and described in connection with specific embodiments, it is to be understood that such embodiments are by way of example and are not limiting.

The invention claimed is:

1. An LED light fixture comprising:

a housing including a substantially closed chamber having two chamber portions including a first chamber portion enclosing an electronic normal-operation LED-driver(s) receiving power from a general off-location power source during normal operation, and at least one second chamber portion enclosing a backup battery/batteries capable of providing power during a power outage, the backup LED-driver unit drawing battery power during a power outage; and an LED assembly outside the chamber to permit ambient-fluid flow over the LED assembly, the LED assembly including an elongate heat sink and an LED-array module connected to the heat sink for heat transfer from the LED-array module.

2. The LED light fixture of claim 1 wherein the first chamber portion and the at least one second chamber portion each form separate enclosures.

3. The LED light fixture of claim 1 wherein the first chamber portion includes:

at least one electronic backup LED-driver unit enclosed therewithin, the backup LED-driver unit drawing battery power during a power outage.

4. The LED light fixture of claim 3 wherein the chamber is substantially water/air-tight.

5. The LED light fixture of claim 3 wherein the LED assembly has a plurality of the LED-array modules only a subset of which is being powered by the backup LED-driver unit during power outage.

6. The LED light fixture of claim 5 wherein the subset is a single LED-array module.

7. The LED light fixture of claim 3 wherein the backup LED-driver unit is configured to sense whether power is being provided by the general off-location power source.

8. The LED light fixture of claim 7 wherein the backup LED-driver unit is configured to sense whether the LED light fixture has been turned off and to preclude the drawing of battery power when the LED light fixture has been turned off.

9. The LED light fixture of claim 8 wherein the backup LED-driver unit is configured for charging the backup battery/batteries from the general off-location power source during normal operation.

10. The LED light fixture of claim 9 wherein the backup LED-driver unit includes a charge-level sensor for determining whether there is a need for battery charging.

11. The LED light fixture of claim 3 wherein the backup LED-driver unit is configured for charging the backup battery/batteries from the general off-location power source during normal operation.

12. The LED light fixture of claim 11 wherein the backup LED-driver unit includes a charge-level sensor for determining whether there is a need for battery charging.

13. The LED light fixture of claim 1 wherein the housing is a perimetrical structure such that the chamber is perimetrical and substantially surrounds the LED assembly.

14. An LED light fixture comprising:

a housing which is a perimetrical structure including a substantially closed perimetrical chamber, the housing including a border structure forming a border-portion of the chamber, and a frame structure forming a frame-portion of the chamber and secured to the border structure;

at least one electronic normal-operation LED-driver enclosed within the chamber and receiving power from a general off-location power source during normal operation;

at least one backup battery within the chamber capable of providing power during a power outage;

at least one electronic backup LED-driver unit enclosed within the chamber, the backup LED-driver unit drawing battery power during a power outage; and an LED assembly outside the chamber to permit ambient-fluid flow over the LED assembly, the chamber substantially surrounding the LED assembly, the LED assembly including an elongate heat sink and an LED-array module connected to the heat sink for heat transfer from the LED-array module, the LED-array module being electrically connected to the border structure.

15. The LED light fixture of claim 14 wherein:

the electronic normal-operation LED-driver(s) and the backup LED-driver unit(s) are enclosed within the frame-portion of the chamber; and the backup battery/batteries is/are enclosed within the border-portion of the chamber.

16. The LED light fixture of claim 15 wherein the border structure has at least one end configured for sealing engagement with respect to the frame structure.

17. The LED light fixture of claim 16 wherein the frame-portion of the chamber includes walls terminating at an open end and a removable cover-plate in substantially water-tight sealing engagement with the open end.

18. The LED light fixture of claim 14 wherein the housing is a substantially perimetrical rectangular structure and includes a pair of the frame structures and a pair of the border structures, each border structure being secured to each of the frame structures.

19. The LED light fixture of claim 18 wherein:

the electronic normal-operation LED-driver(s) and the backup LED-driver unit(s) are enclosed within the frame-portion of the chamber; and the backup battery/batteries is/are enclosed within the border structure(s).

20. The LED light fixture of claim 19 wherein there are two of the backup batteries, one in each of the border structures.

21. The LED light fixture of claim 1 wherein the LED assembly has a plurality of the LED-array modules only a subset of which is being powered during power outage.

22. The LED light fixture of claim 21 wherein the subset is a single LED-array module.

23. An LED light fixture comprising:

a housing which is a perimetrical structure including a substantially closed perimetrical chamber, the housing including a border structure forming a border-portion of the chamber, and a frame structure forming a frame-portion of the chamber and secured to the border structure;

at least one electronic LED-driver unit enclosed within the chamber, the electronic LED-driver unit including at least one backup battery capable of providing power during a power outage; and an LED assembly outside the chamber to permit ambient-fluid flow over the LED assembly the chamber substantially surrounding the LED assembly, the LED assembly including an elongate LED heat sink and an LED-array module connected to the heat sink for heat transfer from the LED-array module, the LED-array module being electrically connected to the border structure.

24. The LED light fixture of claim 23 wherein the electronic LED-driver unit includes at least one normal operation LED-driver receiving power from a general off-location power source during normal operation.

25. The LED light fixture of claim 24 wherein the electronic LED-driver unit includes at least one backup LED-driver drawing battery power during a power outage.

26. The LED light fixture of claim 4 further including substantially water/air-tight wire-access(es) along the side of the border structure for receiving wire(s) from the LED assembly into the chamber.

27. The LED light fixture of claim 1 wherein the housing and the heat sink defining an air gap permitting ambient-fluid flow to and from the heat sink.

28. The LED light fixture of claim 27 further including an interlock of a side of the housing with at least one of the heat-sink ends to secure the LED assembly to the housing, the interlock forming the air gap between the heat-sink end and the housing.

* * * * *

UNITED STATES PATENT AND TRADEMARK OFFICE

CERTIFICATE OF CORRECTION

PATENT NO. : 7,771,087 B2
APPLICATION NO. : 11/744732
DATED : August 10, 2010
INVENTOR(S) : Wilcox et al.

It is certified that error appears in the above-identified patent and that said Letters Patent is hereby corrected as shown below:

In column 1, line 55, delete “an” and insert --a--.

In column 3, line 54, delete “in” and insert --is--.

In column 7, line 25, delete “illustrates” and insert --illustrate--.

In column 10, line 38, delete “an”.

In column 12, claim 13, line 8, delete “1” and insert --3--.

Signed and Sealed this
Fifth Day of April, 2011

David J. Kappos

David J. Kappos
*Director of the United States Patent and Trademark Office*